US006328415B1

(12) United States Patent
Norton et al.

(10) Patent No.: US 6,328,415 B1
(45) Date of Patent: Dec. 11, 2001

(54) DISPLACEABLE PRINT CARTRIDGE CHUTE

(75) Inventors: Kirkpatrick W Norton; Kerry N McKay; Junji Yamamoto; Christopher S Magirl, all of San Diego; Mark A Hay, Poway, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/303,257

(22) Filed: Apr. 30, 1999

(51) Int. Cl.[7] ..... B41J 23/00
(52) U.S. Cl. ..... 347/37
(58) Field of Search ..... 347/37, 108, 32, 347/85, 86; 400/38, 54, 84

(56) References Cited

U.S. PATENT DOCUMENTS

| | | | | |
|---|---|---|---|---|
| 4,514,100 | | 4/1985 | LaSpesa et al. . | |
| 4,530,611 | | 7/1985 | Borcenk et al. . | |
| 4,907,018 | | 3/1990 | Pinkerpell et al. . | |
| 5,020,926 | * | 6/1991 | Wilhelm | 400/54 |
| 5,049,898 | | 9/1991 | Arthur et al. . | |
| 5,408,746 | | 4/1995 | Thoman et al. . | |
| 5,617,128 | | 4/1997 | Thoman et al. . | |
| 5,646,665 | | 7/1997 | Swanson et al. . | |
| 5,712,669 | | 1/1998 | Swanson et al. . | |
| 5,870,117 | | 2/1999 | Moore . | |
| 5,870,125 | | 2/1999 | Swanson et al. . | |
| 6,065,831 | * | 5/2000 | Kawaura et al. | 347/108 |

* cited by examiner

*Primary Examiner*—John Barlow
*Assistant Examiner*—Charles W. Stewart, Jr.
(74) *Attorney, Agent, or Firm*—Robert C. Sismilich

(57) ABSTRACT

A displaceable print cartridge chute for an inkjet printer. The chute holding the print cartridges is displaceable from the carriage that sweeps the cartridges relative to the media during printing. The chute can be moved from a printing position engaged with the carriage to a service position adjacent a side of the printer so as to facilitate installation and removal of the cartridges through the side rather than the top of the printer. Because cartridges are serviced through the side, a printer incorporating the displaceable print cartridge chute can be stacked with other electronic equipment.

33 Claims, 12 Drawing Sheets

DISPLACEABLE PRINT CARTRIDGE CHUTE

CROSS-REFERENCE TO RELATED APPLICATIONS

This application relates to the subject matter disclosed in the co-pending application Ser. No. 09/303,256, filed concurrently herewith, entitled "Print Cartridge Latching Mechanism for a Displaceable Print Cartridge Chute".

FIELD OF THE INVENTION

The present invention relates generally to inkjet printers. It relates more particularly to the mounting and electrical connection of thermal inkjet print cartridges in the printer.

BACKGROUND OF THE INVENTION

Inkjet printers, and thermal inkjet printers in particular, have come into widespread use in businesses and homes because of their low cost, high print quality, and color printing capability. The operation of such printers is relatively straightforward. In this regard, drops of a colored ink are emitted onto the print media during a printing operation, in response to commands electronically transmitted to the printhead. These drops of ink combine on the print media to form the text and images. Inkjet printers may use a number of different ink colors. One or more printheads may be contained in a print cartridge, which may either contain the supply of ink for each printhead or be connected to an ink supply located off-cartridge. An inkjet printer frequently can accommodate two to four print cartridges. The cartridges typically are mounted side by side in a chute attached to a carriage which sweeps the cartridges back and forth within the printer during printing.

While inkjet printers have achieved a high level of reliability, there are times when the cartridges containing the printhead must be accessed by the owner or user of the printer. If the cartridge contains the ink supply for the printhead, it must be removed for replacement or refill when the supply runs out. Even if the ink supply is off-cartridge, the printheads may occasionally clog and need manual cleaning.

Print cartridges have typically required access from a top portion of the printer. In some printers, most if not all inkjet cartridges are positioned within the printer at some distance from any one of the wall members, thus making access from a wall side of the printer impractical. Even if the back and forth movement of the cartridges during printing brings them near to a side of the printer, access to all but the cartridge nearmost the side wall member is not feasible. In other inkjet printers, a latching lever which holds the print cartridge in place must be flipped up from the top to remove the cartridges. In yet other inkjet printers, keying features which ensure that different color cartridges are installed in the correct chute stalls require a substantially vertical insertion of the cartridge during installation. The need for top access increases as the height of the print cartridge approaches the height of the printer, as can occur when cartridges become taller to hold more ink, or printer heights are reduced to conserve space.

While access to install and remove cartridges from a top portion of the printer has been generally satisfactory for most office and home environments, with the introduction of internet appliances such access is not generally satisfactory. More particularly, internet appliances such as cable boxes, DVD players, and other such electronic components must generally be stackable. Thus, it would be impractical to position a top access printer in such a stacked arrangement.

Accordingly, it would be highly desirable to have a new and improved inkjet printer that could be stacked with other electronic devices and that would provide access to replace depleted inkjet cartridges in an easy and convenient manner.

SUMMARY OF THE INVENTION

In a preferred embodiment, the present invention may be implemented as a displaceable print cartridge chute that allows print cartridges to be accessed through a side of the printer rather than through the top. A printer constructed in accordance with the present invention can be stacked with other equipment and still provide access to the print cartridges without the need to remove equipment on top of the printer.

Such a printer has, within its enclosure, a chute into which one or more print cartridges may be installed. The chute is attached to a carriage which moves the cartridges along an axis and relative to the print media during a printing operation. The chute and carriage are connected by a mechanism which allows the chute to be located in a proper position for printing on the media, and in a different position for servicing the print cartridges, such as installing or removing them. In some embodiments, the mechanism pivots the chute with respect to the carriage. Preferably, a mechanism is provided to properly align the chute with the carriage in the printing position; for example, mechanical elements on the chute and carriage which mate with each other when the chute engages the carriage.

When the chute is in the service position, an opening in the enclosure near the service position allows an operator to access the cartridges. The opening is preferably located in a vertical side of the enclosure, so that items stacked above or below the printer do not have to be moved. The vertical side containing the opening may either be generally orthogonal to the axis along which the carriage moves, or generally parallel with it. The opening is preferably sized so that the chute can pass partially or completely through it to outside the enclosure for cartridge access from outside the enclosure; alternatively, the chute may not pass through the opening but may move closer to it to allow the operator to reach into the enclosure through the opening to access the cartridges. In some embodiments the chute contains a handle that the operator may use to move the chute. Some embodiments provide a removable cover over the access opening; the cover may be detachable from the enclosure or may be pivotally attached to it.

Preferably, a latching mechanism on the chute engages the carriage to maintain the chute in the printing position; the latch is disengaged when it is desired to move the chute into the service position. In some embodiments a service latch may hold the chute in the service position.

The print cartridge has a set of electrical printhead interconnects for controlling the flow of ink; these interconnects mate with another set of controller interconnects that are attached to the drive electronics. The drive electronics signal the printhead in the print cartridge to emit ink onto the media. The mating set of controller interconnects may be located in the chute and contact the printhead interconnects whenever the cartridge is installed in the chute, or alternatively may be located on the carriage and contact the printhead interconnects via an opening in the chute when the chute is located in the printing position.

Other aspects and advantages of the present invention will become apparent from the following detailed description, taken in conjunction with the accompanying drawings, illustrating by way of example the principles of the invention.

BRIEF DESCRIPTION OF THE DRAWINGS

FIG. 7A shows the chute in a printing position and FIG. 7B a service position; a print cartridge is shown installed in one of the two stalls illustrated.

DESCRIPTION OF THE PREFERRED EMBODIMENT

Figure 1A:
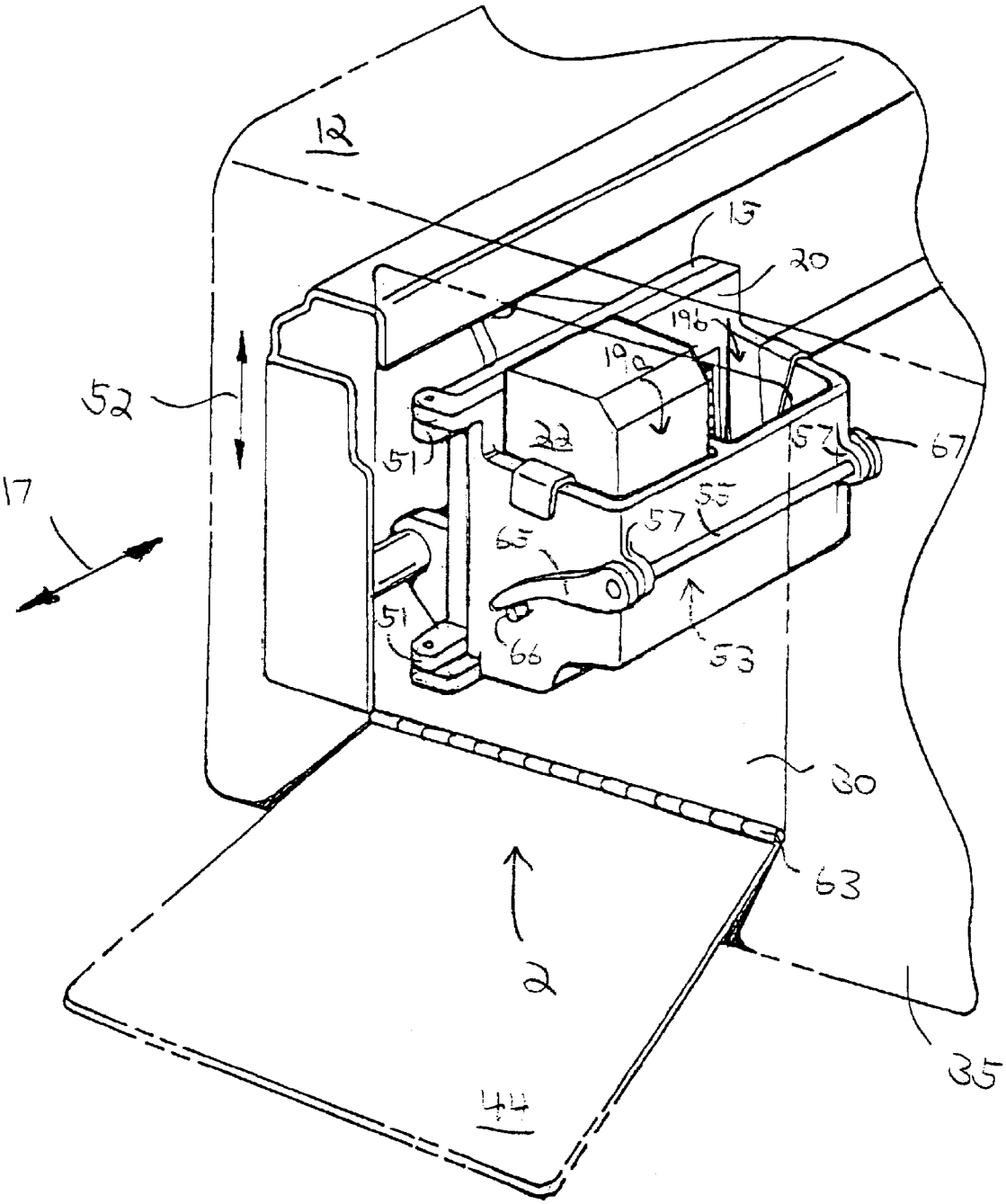
FIGS. 1A–1C are perspective views of a rotationally displaceable print cartridge chute containing controller interconnects, shown in a printing position (FIG. 1A), a service position latched to a side of the printer enclosure (FIG. 1B), and an alternate service position outside the enclosure (FIG. 1C); a print cartridge is shown installed in one of the two stalls illustrated.

Referring now to the drawings and more particularly to FIGS. 1A–1C and 2, there is shown a stackable inkjet printer 10 that is constructed in accordance with the present invention. As will be explained hereinafter in greater detail, the printer 10 is stackable in a home electronics system with other electronic equipment 11.

Figure 2:
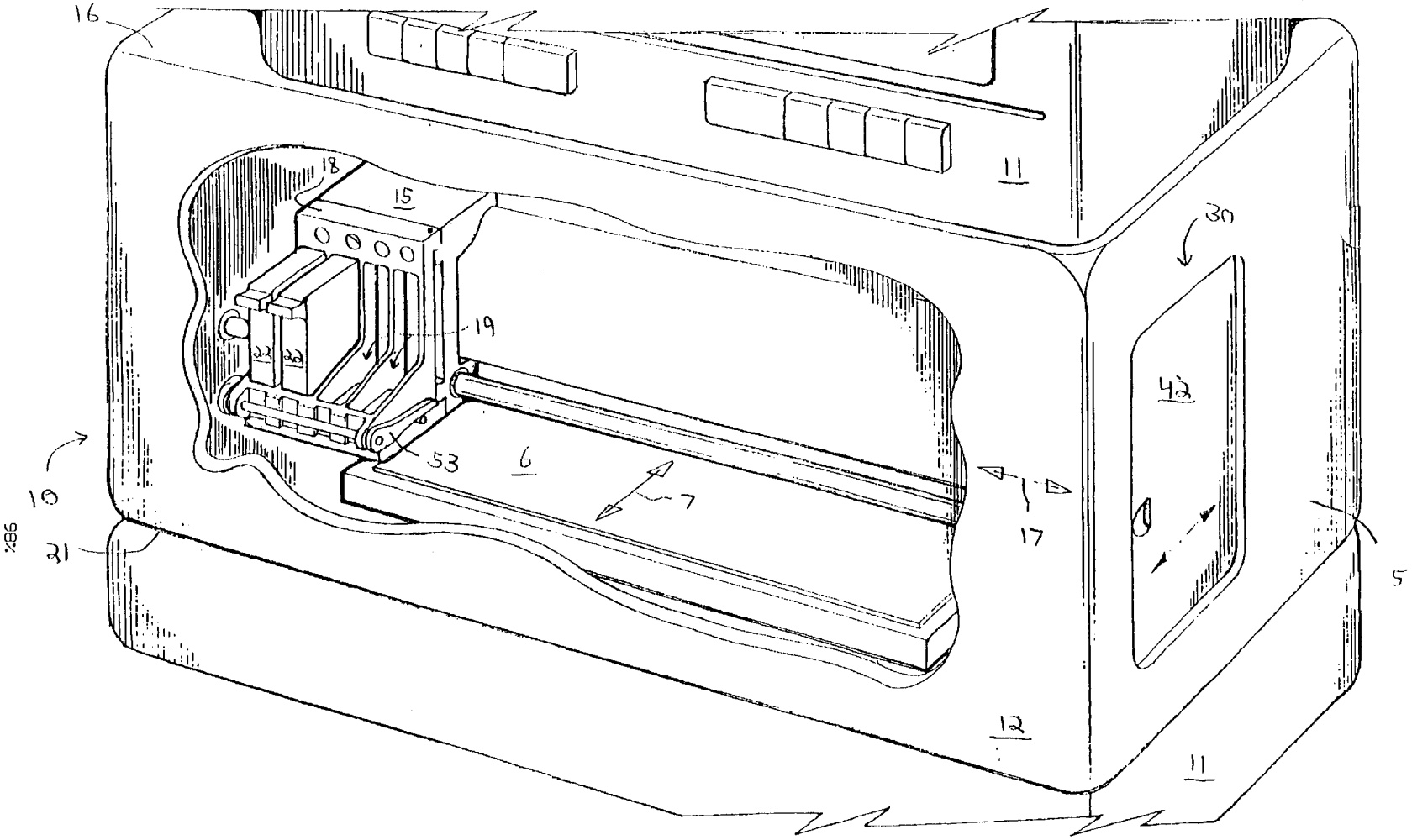
FIG. 2 is a perspective view of a printer embodying the present invention.

As best seen in FIG. 2, the printer 10 includes an enclosure 12 having a plurality of vertical wall members, such as a wall member or side 35, sandwiched between top and bottom surfaces 16 and 21 respectively. The top and bottom planar surfaces 16 and 21 facilitate the stacking of the enclosure 12 with other electronic equipment 11 as best seen in FIG. 2.

Figure 1B:
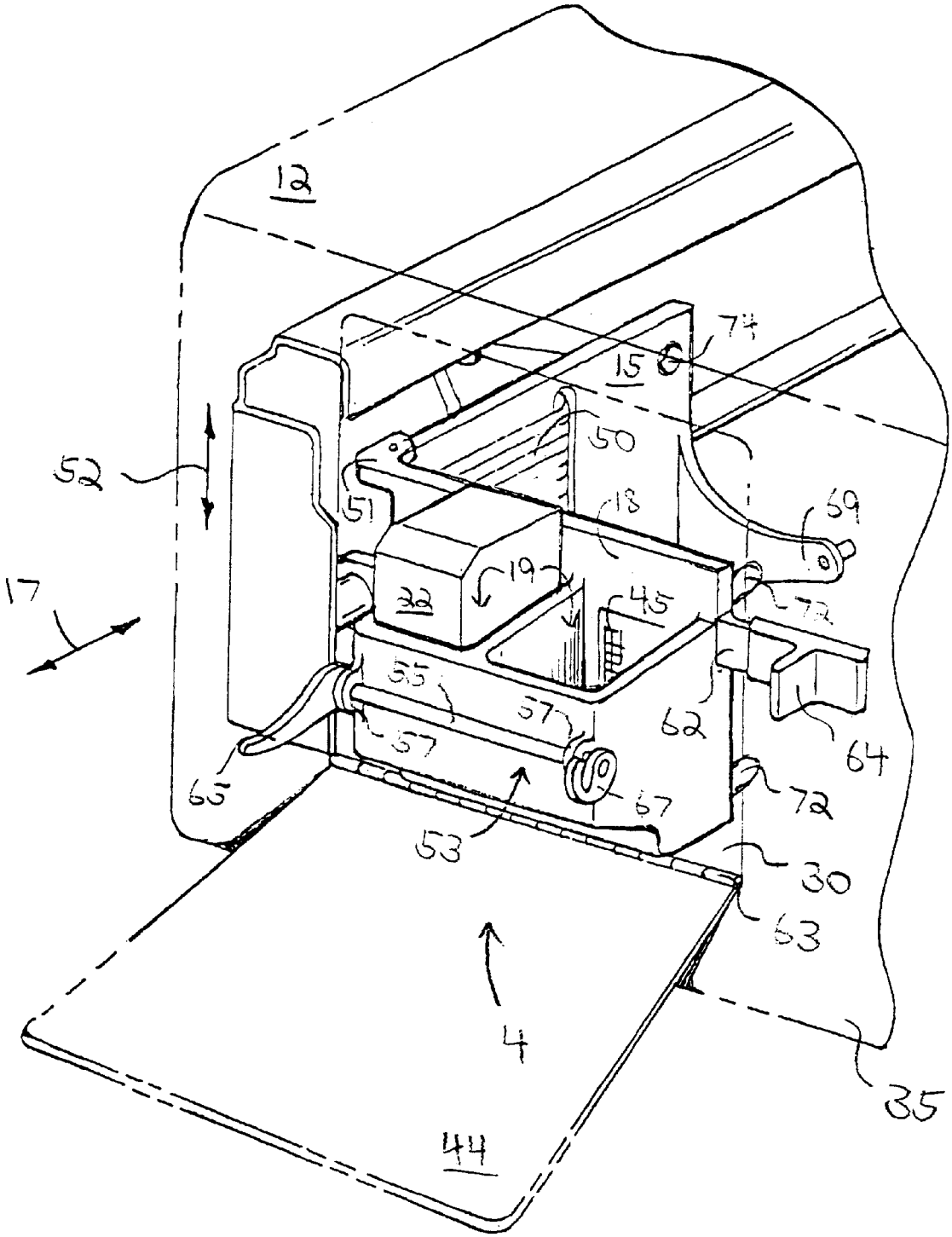
Figure 1C:
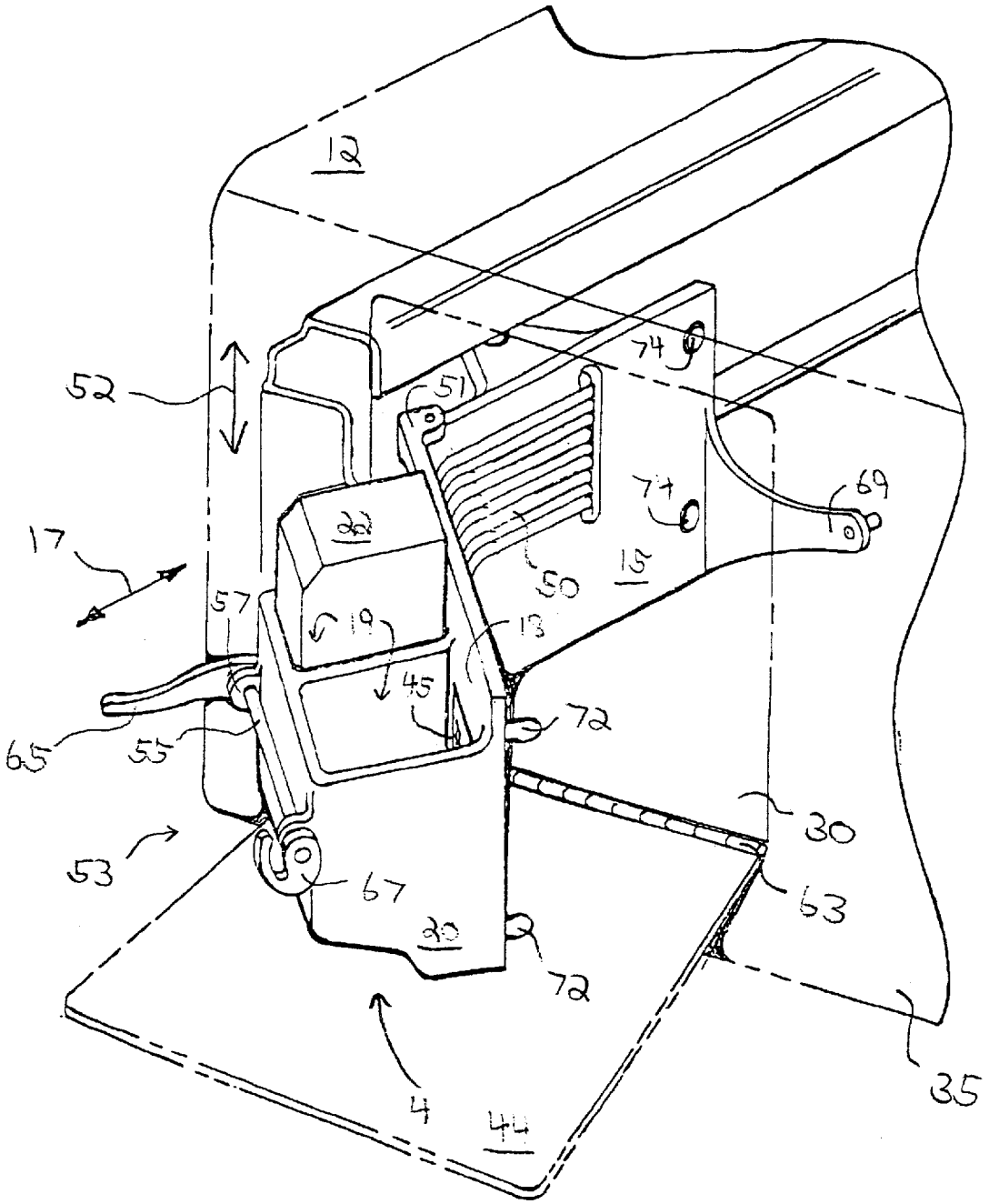

In order to facilitate the ejecting of ink droplets onto a sheet of printing medium 6 as it travels between input and output trays (not shown) within the interior of the enclosure 12, at least one print cartridge 22 is mounted for rectilinear movement within the enclosure 12. In this regard, a slider bar 14 is mounted between a pair of the wall members 35 to define a carriage path of travel indicated generally at 17. A carriage unit 15 having a moveable chute 20 is mounted for travel along the slider bar 14 above the sheet of print medium 6 as the medium 6 travels in a paper path of travel 7 orthogonal to the carriage path of travel 17. The chute 20 is displaceable relative to the carriage 15 between a service position 4 as best illustrated in FIGS. 1B and 1C, and a printing position 2 as best illustrated in FIG. 1A.

The chute 20 is adapted to receive therein the print cartridge 22 in order to hold it in a printing position 2 for ejecting ink downwardly onto the sheet of print medium 6. In this manner, the chute 20 is moveable in a rectilinear path of travel as the chute 20 is transported by the carriage unit 15 as it moves along the slider bar 14 in the carriage path of travel 17. Chute 20 has at least one stall 19 in which a corresponding at least one print cartridge 22 may be installed.

In the preferred embodiment, the chute 20 is mounted to the carriage unit 15 by a pivoting mechanism 51 that enables the chute 20 to be moved to the service position 4 that is at about one end of the carriage path of travel 17. In this regard, the chute 20 is mounted for pivoting movement between about 90 degrees and about 180 degrees to a position either generally perpendicular to or co-extending with the carriage path of travel 17 depending on whether the chute is pivoted 90 degrees or 180 degrees respectively.

In order to permit the print cartridges 22 disposed within the chute 20 to be easily accessed by a user, the vertical wall 35 disposed adjacent to the service position 4 includes an access opening 30. The access opening 30 has sufficient height and width dimensions to enable the user to easily install or remove the print cartridge 22 via the access opening 30.

As shown in FIG. 2, a sliding door 42 covers the access opening 30 and is moveable along a pair of recessed tracks (not shown) disposed within the wall member 35. The sliding door 42 is slideable between open and closed positions. In the open position the access opening 30 is uncovered allowing access to the print cartridges 22 disposed within the chute 20.

Figure 3B:
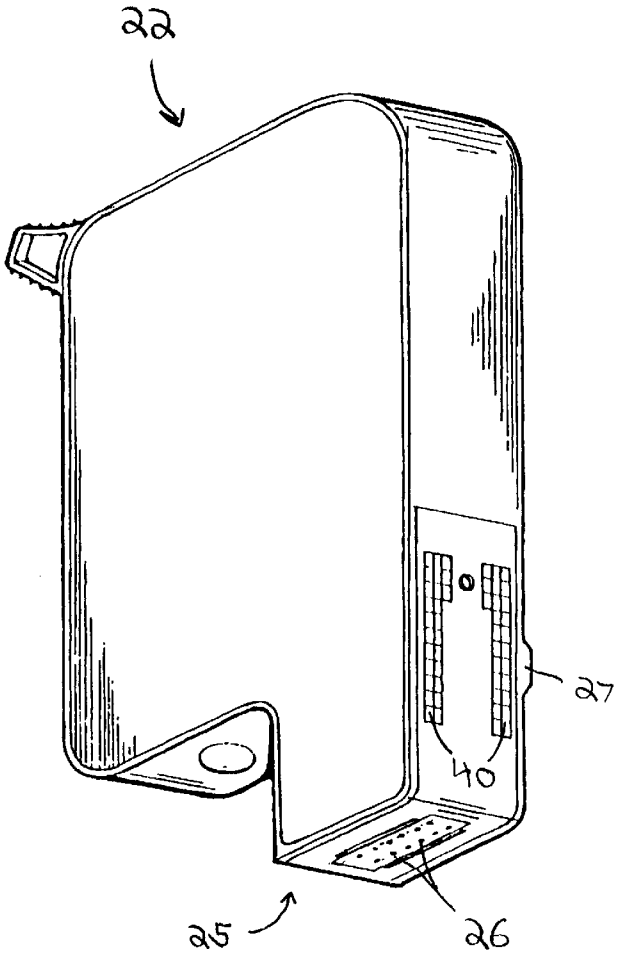
FIG. 3B PRIOR ART
FIGS. 3A–3B are perspective views of a prior art print cartridge usable in a printer according to the present invention.
Figure 3A:
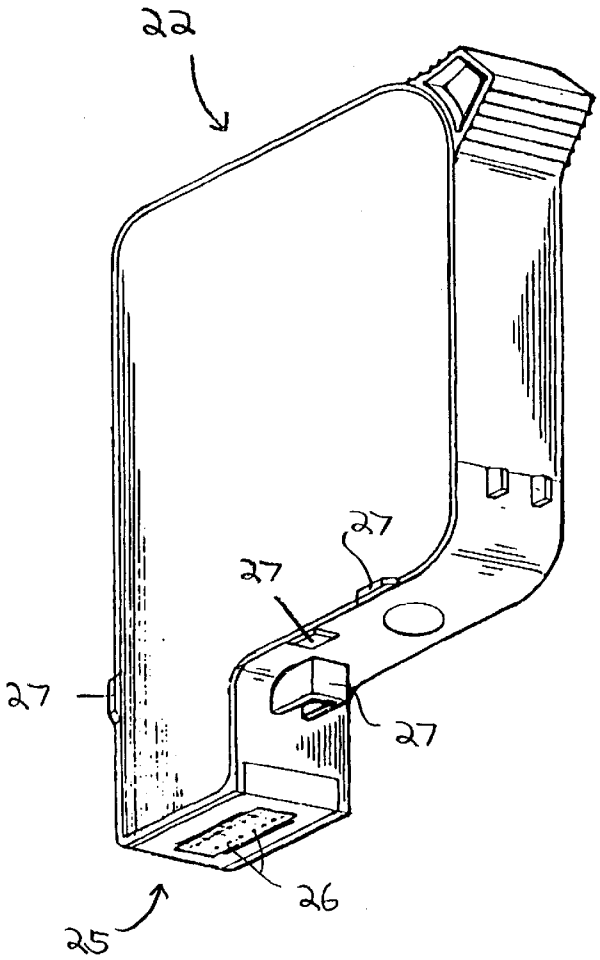
FIG. 3A PRIOR ART

Before discussing the apparatus embodying the present invention in further detail, it may be beneficial to briefly review the elements of a prior art print cartridge usable with the present invention. An exemplary mechanical configuration of the cartridge 22 is shown in FIG. 3. The cartridge 22 contains a thermal inkjet printhead 25 located at the bottom of the cartridge. The printhead 25 is well known in the art, and includes a plurality of print nozzles 26 disposed in a printhead plane that is generally parallel to the print media sheet 6. In this exemplary embodiment the nozzles 26 eject ink droplets in a direction generally orthogonal to the printhead plane. As will be discussed hereinafter, the cartridge 22 is also provided with printhead interconnects 40 to electrically connect the printhead 25 to drive electronics 48 which will be described hereinafter to control the emission of ink from the printhead 25. Datums 27 on the cartridge 22 cooperate with a guide arrangement on the chute to properly align the cartridge 22 in the chute 20 so that printhead interconnects 40 align with and forcibly contact mating controller interconnects 45 associated with each stall 19 as best shown in FIG. 1B which are in electrical communication with the print controller electronics 49. The datums 27 and the guide arrangement also align the printhead 25 relative to the print media 6. The shape and dimensions of the cartridge 22 can vary from that shown, and thus the shape and dimensions indicated herein are illustrative only and are not meant to limit the present invention. Exemplary configurations of cartridge datums and guide arrangements usable with the present invention are described in U.S. Pat. No. 5,408,746, "Datum Formation for Improved Alignment of Multiple Nozzle Members in a Printer", by Thoman et al., and in U.S. Pat. No. 5,646,665, "Side Biased Datum Scheme for Inkjet Cartridge and Carriage", by Swanson et al., both of which are assigned to the assignee of the present invention and are also hereby incorporated by reference. The shape and dimensions of the cartridge 22 and its elements can vary from that shown in FIG. 3, and thus the shape and dimensions described herein are illustrative only and are not meant to limit the present invention.

Considering now the attachment of the chute 20 to the carriage 15 in greater detail, the present invention contemplates a variety of relative displacements of the chute 20 from the carriage 15 as the chute 20 moves from the printing position 2 to the service position 4. A corresponding variety of attaching mechanisms for connecting the chute 20 to the carriage 15 allows these displacements. As shown in FIGS. 1A through 1C, one embodiment provides access to the print cartridges 22 through a side 35 of the enclosure 12 generally orthogonal to the carriage axis 17. To access the cartridges 22 in the preferred embodiment, the carriage 15 with the chute 20 located in the printing position 2 is moved along the slider bar 14 to a position adjacent the side 35. When the chute 20 is in the printing position 2 as shown in FIG. 1A, an operator must reach into the printer 10 through the side 35 in order to reach one or more cartridges 22. This operation is difficult when the printer 10 has a relatively low height, due to a lack of access room for the user to grasp the cartridge 22. More significantly, if the chute 20 accommodates a plurality of cartridges 22, the cartridge 22 in stall 19*a* closest to the side 35 inhibits access to cartridges in any stalls behind it such as stall 19*b* while the chute 20 is in the printing position 2. In order to provide convenient access to all cartridges, a pivoting mechanism 51 is attached between the chute 20 and the carriage 15 at ends of the chute 20 and carriage 15 adjacent to the side 35. The axis 52 of the pivoting mechanism 51 is generally orthogonal to the carriage axis 17. The pivoting mechanism 51 allows the chute to rotate into the service position 4 angularly displaced from the printing position 2 towards the side 35 of the enclosure 12. In FIGS. 1A–1C the pivoting mechanism 51 is implemented as two hinges providing pivoting of the chute 20 about a common axis 52. However, the invention does not limit the pivoting mechanism 51 to one or more hinges; any pivoting mechanism known to those skilled in the art, such as a sliding guide or a multiple bar linkage, may be substituted for the hinge arrangement.

Figure 4C:
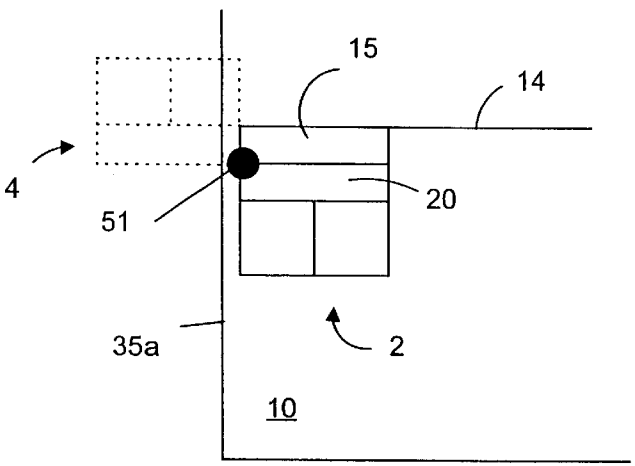
FIGS. 4A–4C are simplified top views of printers embodying the present invention showing differing displacements of a rotationally displaceable print cartridge chute from to the carriage; printing positions are shown in solid and service positions are shown in phantom.
Figure 4A:
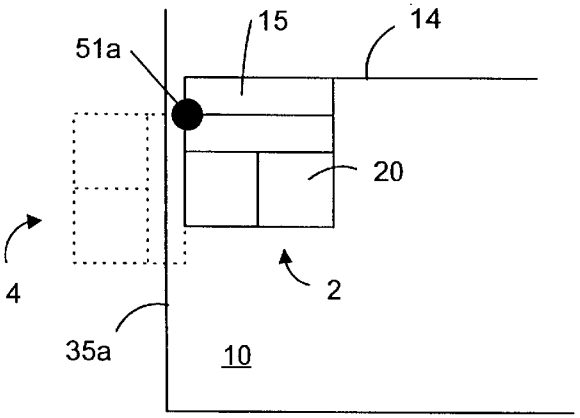
Figure 4B:
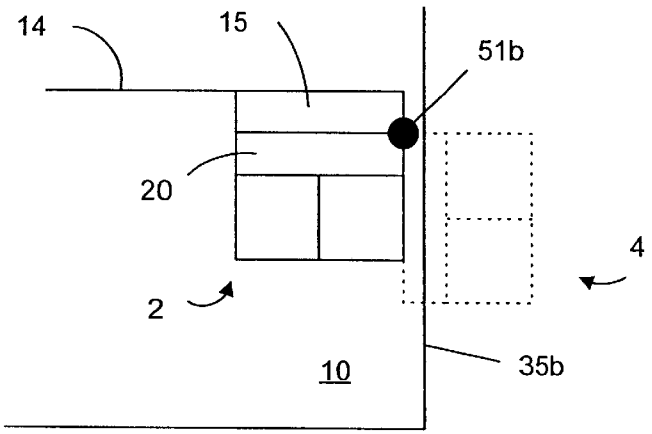

As best seen in the simplified top views of FIGS. 4A and 4B, the side 35 through which access is provided can be located adjacent either end of the slider bar 14. FIG. 4A shows the service position 4 at the left side 35*a* of the printer 10, with the pivoting mechanism 51*a* located at left ends of the chute 20 and carriage 15. FIG. 4B shows the service position 4 at the right side 35*b* of the printer 10, with the pivoting mechanism 51*b* located at right ends of the chute 20 and carriage 15. The chute 20 can be pivoted to a service position 4 approximately 90 degrees displaced from the carriage 15 (FIGS. 4A and 4B), or to a service position 4 approximately 180 degrees displaced from the carriage 15 (FIG. 4C).

Considering now in greater detail the printing position 2 as shown in FIG. 2, the one or more cartridges 22 installed in the chute 20 are properly positioned for each printhead 25 to deposit drops of ink on the print media 6 when the chute 20 is located in the printing position 2. In the printing position 2, each printhead 25 is properly oriented to and distanced from the media 6 so as to produce print output of desired quality. When the carriage 15 moves along the carriage axis 17 during printing it sweeps each cartridge 22 in the attached chute 20 across the media 6 so that the ink can be deposited in the appropriate position on the media 6. When the chute 20 is in the printing position 2, it is latched to the carriage 15 to prevent displacement of the chute 20 from the carriage 15 during printing. A latching mechanism indicated generally at 53 and movably attached to the chute 20 releasably engages the carriage 15 in order to maintain the chute 20 in the printing position 2.

Considering now the access opening 30 in greater detail, the opening 30 in the enclosure 12 is provided at a location proximate to the service position 4 of the chute 20. In the preferred embodiment, the opening 30 is located where the chute 20 intersects the enclosure to facilitate operator access to the cartridges 22 when the chute 20 is in the service position 4. The opening 30 has a height and width sufficient for the operator to access the cartridges 22 for service purposes.

In the preferred embodiment, the height and width of the opening 30 are dimensioned to allow the chute 20 to be moved to a service position 4 at least partially outside the enclosure. When the chute 20 is in the service position 4, the operator can insert and remove the cartridges 22 from outside the enclosure as shown in FIG. 1B where a full range of vertical movement of the cartridges 22 during insertion and removal is enabled. The base 18 of the chute 20 remains within the enclosure 12, while the one or more stalls 19 project through the opening 30. As shown in FIG. 1B, a service latch 64 may be attached to the enclosure 12 adjacent to the opening 30. The service latch 64 is located such that it releasably engages a latching member 62 on the chute 20 so as to maintain the chute 20 in the service position 4 when cartridges 22 are being installed in or removed from the chute 20. The latch 64 provides sufficient engagement with the chute 20 to hold it in the service position 4 when the force required to install or remove the cartridges 22 is applied. The latch 64 is operated to disengage the chute 20 prior to moving the chute 20 from the service position 4 to the printing position 2. In an alternate embodiment, the height and width of the access opening 30 are such as to allow the chute 20 to be positioned generally outside of the enclosure 12 as shown in FIG. 1C. In this embodiment, the operator can manually hold the chute 20 in position while installing or removing the cartridges 22.

Returning now to the access opening 30, a cover 44 may alternatively be removably positioned over the opening 30 as shown in FIGS. 1A–1C. The cover 44 may be attached to the enclosure 12 along one edge of the opening 30 via a hinge and pin arrangement 63 so as to enable the cover 44 to rotate between an open and a closed position, or alternatively the cover 44 may be completely detachable from the enclosure 12. Other implementations of a cover or door over an opening known to those skilled in the art may be utilized with the present invention; the invention is not limited to the embodiments disclosed.

Considering now the latching mechanism 53 in greater detail as shown in FIGS. 1A–1C, a shaft 55 is rotatably mounted to the chute 20. In the preferred embodiment, the shaft 55 passes through at least two openings 57 in the chute 20 which are aligned and sized to allow rotation of the shaft 55. A latching fastener is attached to the shaft 55 and engages a mating element on the carriage 15. In the preferred embodiment, the latching fastener is a cam latch 67 attached proximate one end of the shaft 55, and the mating element is a latch pin 69 attached to the carriage 15. An actuating handle 65 is attached at the other end of the shaft 55 and is accessible by reaching into the enclosure 12 through the access opening 30 when the chute 20 is in the printing position 2. When the handle 65 is rotated by a user, the cam latch 67 attached at the other end of the shaft 55 is similarly rotated. In the preferred embodiment, the cam latch 67 is adapted to engage the latch pin 69, which is attached to the carriage 15 in a location such that when fully engaged the chute 20 is maintained in the printing position 2 as shown in FIG. 1A.

A stop arrangement limits the rotation of the shaft. A preferred embodiment of the stop arrangement is a stop pin 66 attached to the chute 20 which engages the handle 65 as it is rotated. An alternate embodiment of the stop arrangement is the depth of the slot in the cam latch 67 which engages the latch pin 69.

The cam latch 67 operates to prevent displacement of the chute 20 from the carriage 15 as the carriage 15 moves along the carriage axis 17 and sweeps each cartridge 22 in the chute 20 across the media 6 so that the ink can be deposited in the appropriate position on the media 6 during printing. When the latch 67 is disengaged from the pin 69 as shown in FIGS. 1B–1C, the handle 65 functions as a lever to allow the user to transmit the force necessary to move the chute 20 from the printing position 2 to the service position 4 of FIGS. 1B–1C and vice-versa.

Other implementations of a latching mechanism known to those skilled in the art may be utilized with the present invention to latch the chute 20 to the carriage 15 in the printing position 2; the invention is not limited to the embodiments disclosed herein.

Considering now the alignment of the chute 20 with the carriage 15, the chute 20 includes at least one first mating member, each first mating member engaging with a corresponding second mating member located on the carriage 15. When the first and second mating members are engaged, the chute 20 is maintained in proper alignment for the printing position 2. In a preferred embodiment, the first mating member is a locating pin 72, and the second mating member is a locating hole 74. Other alignment mechanisms known to those skilled in the art may be utilized with the present invention; the invention is not limited to the embodiments disclosed.

Figure 5A:
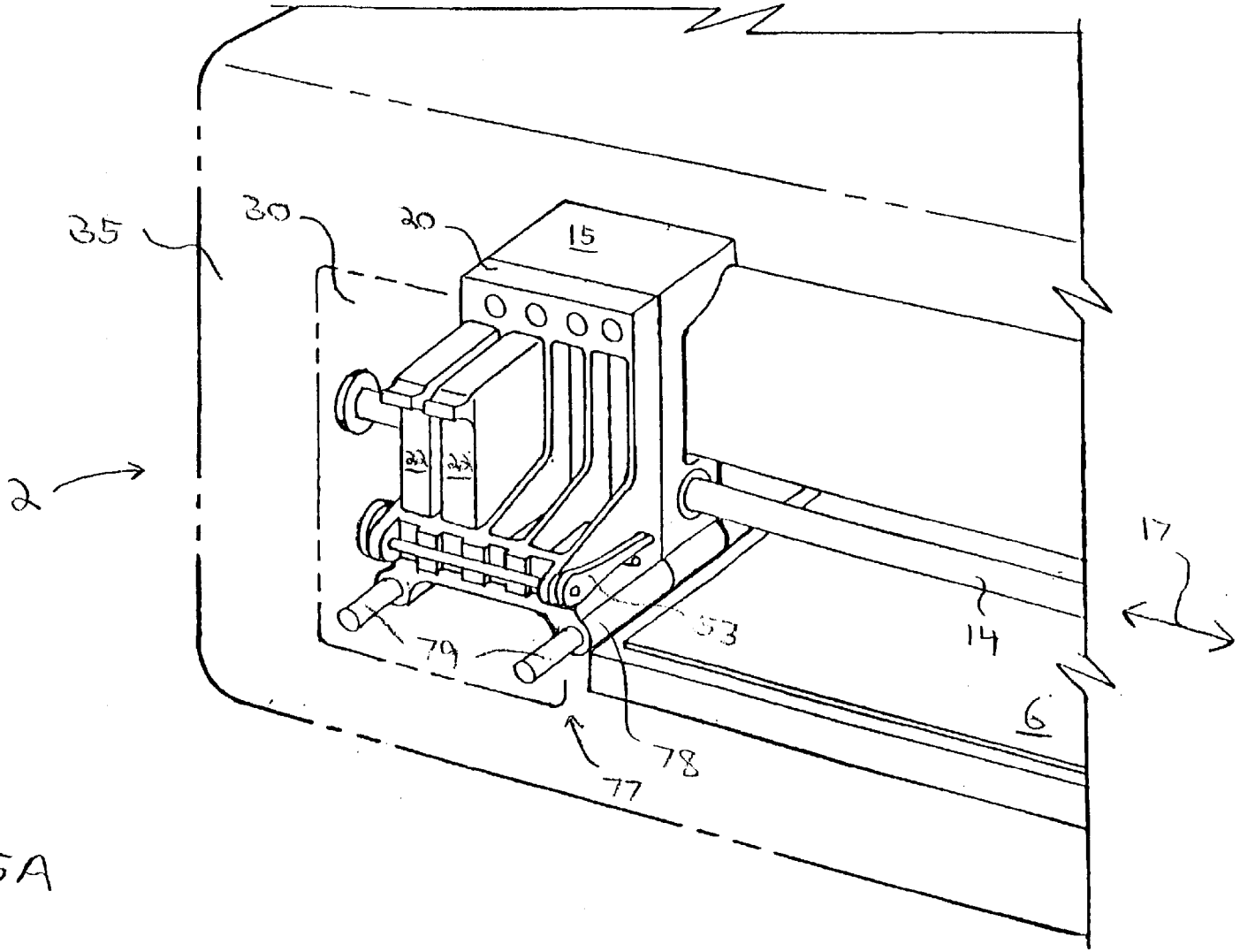
FIGS. 5A–5B are perspective views of a linearly displaceable print cartridge chute shown in a printing position and a service position respectively.
Figure 5B:
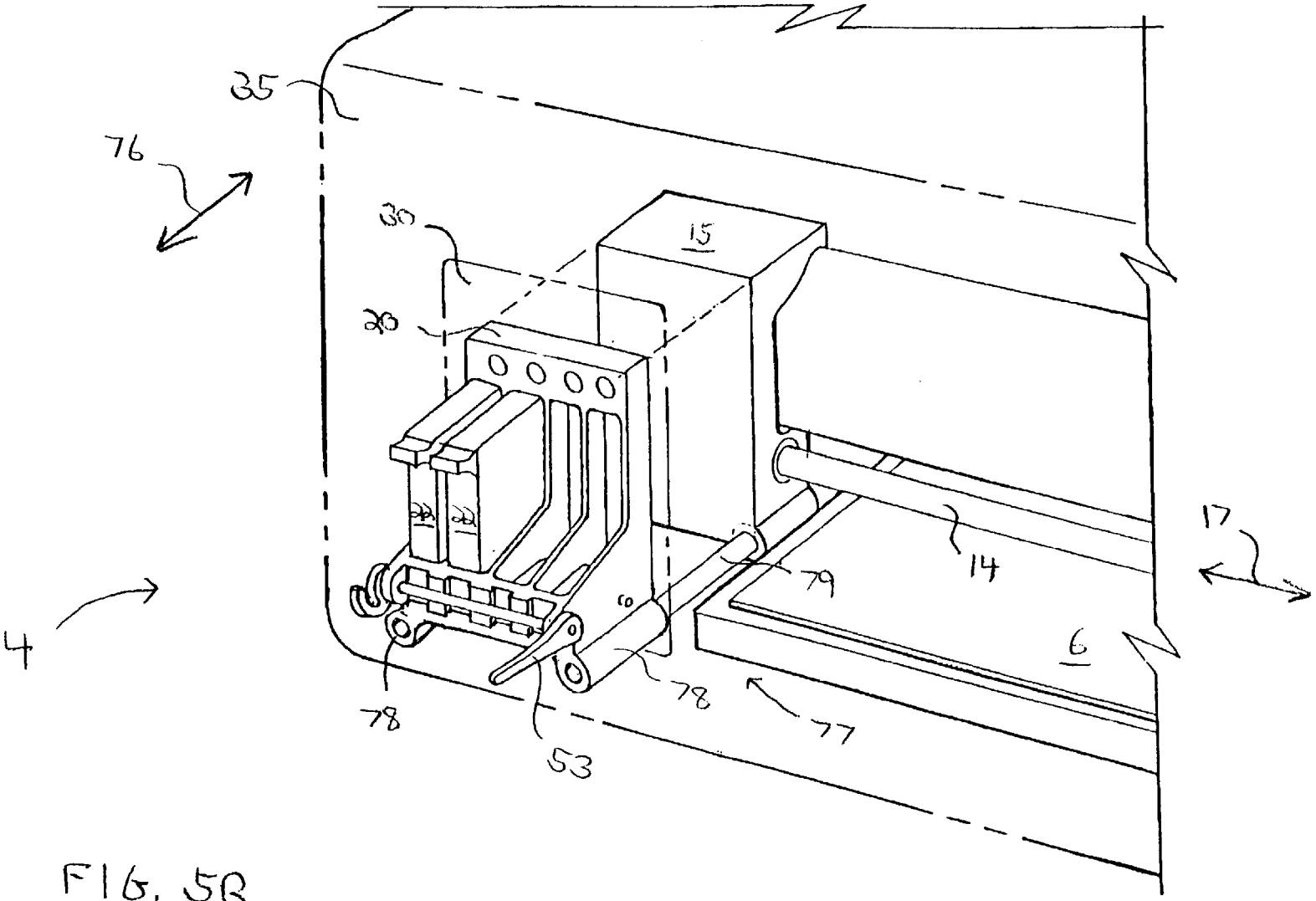

Returning to the attachment of the chute 20 to the carriage 15, as mentioned previously the present invention contemplates a variety of relative displacements of the chute 20 from the carriage 15 as the chute 20 moves from the printing position 2 to the service position 4. As shown in FIGS. 5A–5B, an alternative embodiment of the attaching mechanism provides access to the cartridges 22 through a side 35 of the printer enclosure 10 generally parallel to the slider bar 14. An extension mechanism indicated generally at 77 attached to the chute 20 and the carriage 15 allows the chute 20 to be displaced from the printing position 2 (FIG. 5A) in a direction 76 generally orthogonal to the carriage axis of travel 17 toward the side 35 and into a service position 4 (FIG. 5B). Operator access to the cartridges 22 in the service position 4 is provided via an access opening 30 as described previously. A preferred implementation of the extension mechanism 77 includes one or more sleeves 78 mounted to the chute 20 and slidingly engaged with a corresponding one or more slider rods 79 mounted to the carriage 15. However, others mechanical arrangements known to those skilled in the art which provides the aforementioned displacement may alternatively be used with the present invention.

Figure 6:
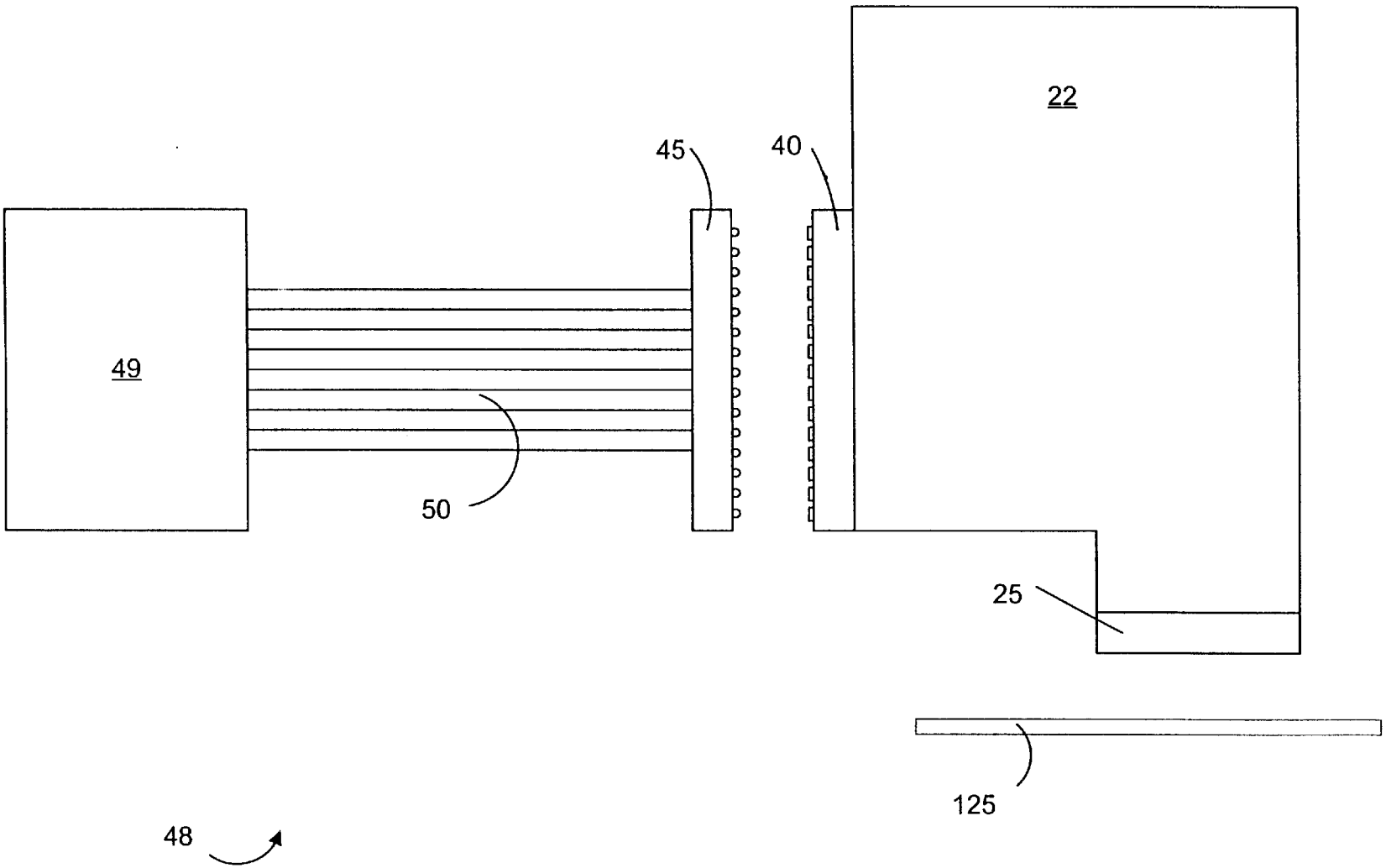
FIG. 6 is a schematic representation of the drive electronics of an inkjet printer usable with the present invention.

Considering now the drive electronics 48 in greater detail with reference to FIG. 6, the drive electronics 48 generally include print controller electronics 49 which control the ejection of ink onto the print media 6 by sending appropriate control signals to the printhead 25 located in the print cartridge 22. A flexible circuit 50 is connected between the print controller electronics 49 and a plurality of controller interconnects 45 mounted on the carriage 15. Each individual controller interconnect 45 is preferably a conductive bump, as described in further detail in the above-referenced U.S. Pat. No. 5,408,746. Each of the controller interconnects 45 mates with a corresponding one of a plurality of printhead interconnects 40 mounted on each cartridges 22 installed in the stall 19. Each individual printhead interconnect 40 is preferably an electrical contact pad mounted to the surface of the cartridge 22, as described in the above-referenced U.S. Pat. No. 5,408,746. The electrical connection to each cartridge 22 is formed by making a forcible mechanical connection between the printhead interconnects 40 and the controller interconnects 45 associated with the chute stall 19 in which the cartridge 22 is installed. The control signals sent by the print controller electronics 49 to the print cartridge 22 through the printhead interconnects 40 control the emission of ink from the printhead 25. Inkjet printer drive electronics 48 are well known to those skilled in the art and can assume different functional and mechanical aspects. Since such electronics are well known to those skilled in the art, they will not be described hereinafter in greater detail.

In the preferred embodiment as best shown in FIG. 1B, the controller interconnects 45 are mounted within the chute stall 19 in a location such that when the cartridge 22 is installed in the chute 20 the controller interconnects 45 are aligned with the printhead interconnects 40. A guide arrangement (not shown) on the chute 20 cooperates with the one or more datums 27 on the cartridge 22 to properly align the controller interconnects 45 with the printhead interconnects 40 when the cartridge 22 is forcibly seated in the chute stall 19 by the operator. Exemplary configurations of guide arrangements usable with the present invention are described in the above-referenced U.S. Pat. Nos. 5,408,746 and 5,646,665. When the cartridge 22 is properly seated, sufficient force is applied to maintain good electrical contact between the printhead interconnects 40 and the controller interconnects 45. The flexible circuit 50 electrically connects the controller interconnects 45 to the printer control electronics 49 and maintains electrical contact while allowing the chute 20 to be displaced from the carriage 15.

Figure 7A:
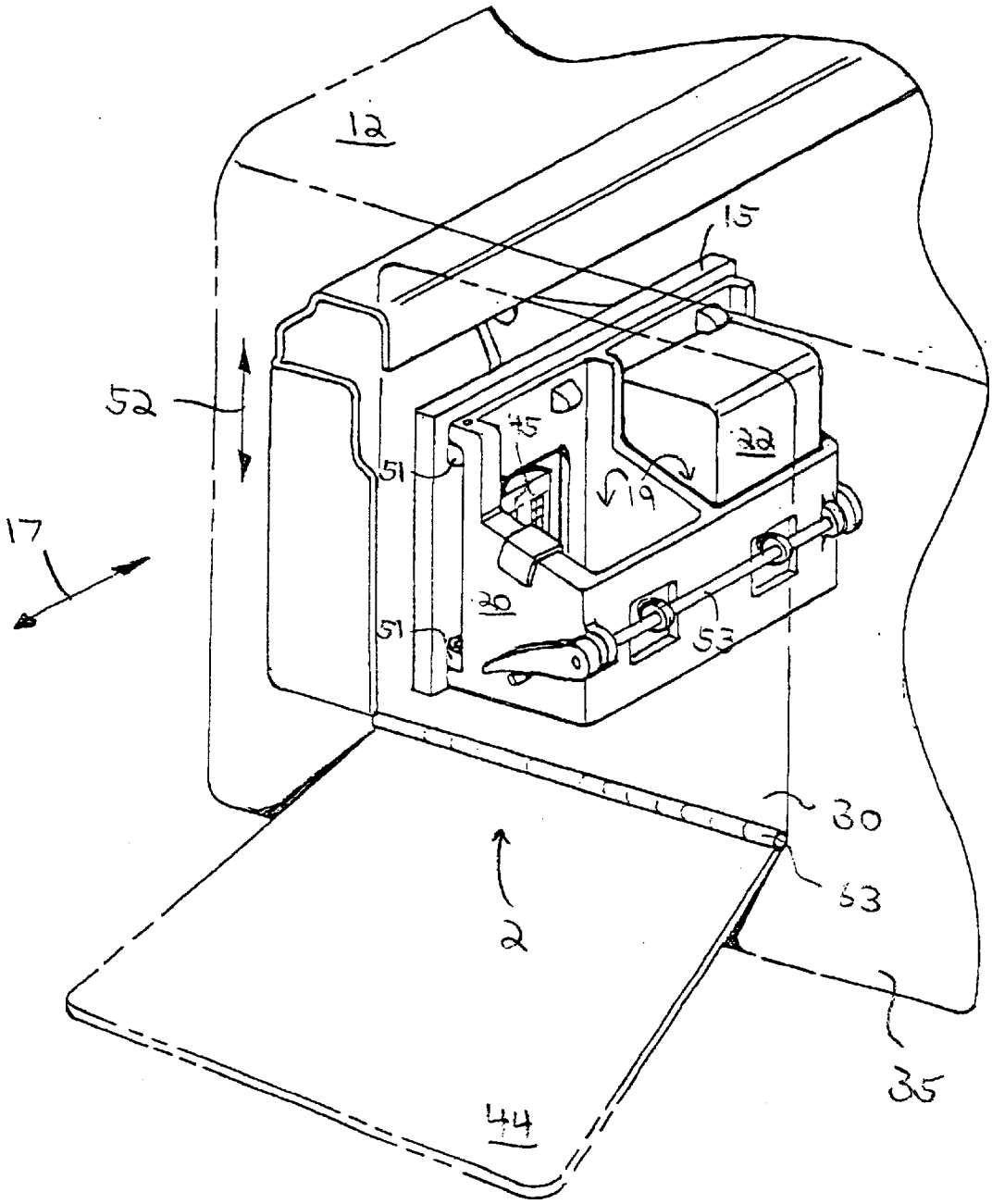
FIGS. 7A–7B are perspective views of another rotationally displaceable print cartridge chute with an opening adjacent controller interconnects located on the carriage.
Figure 7B:
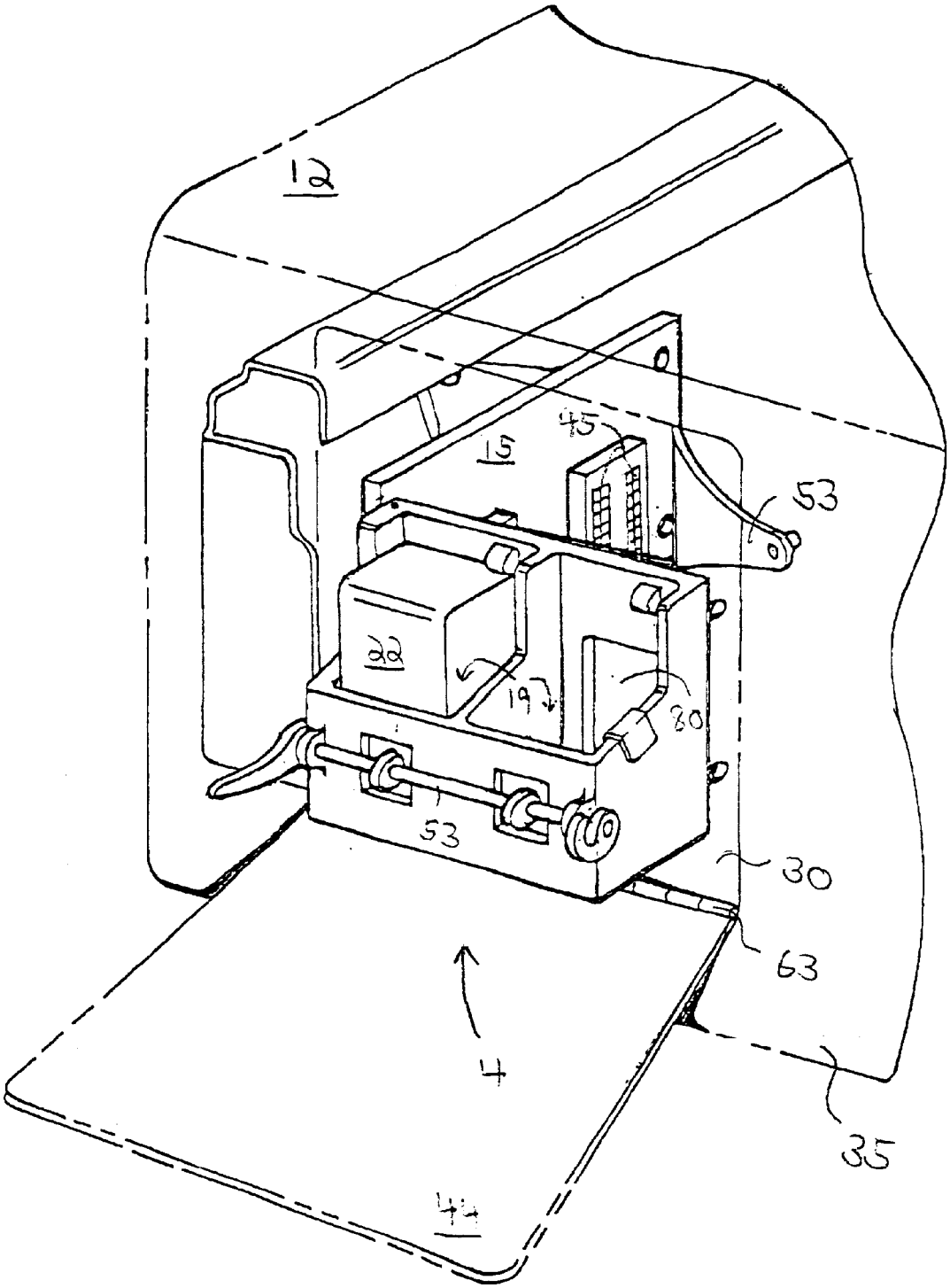

In an alternate embodiment shown in FIGS. 7A–7B, the controller interconnects 45 are not mounted in the chute stall 19 but rather are mounted on the carriage 15 in a location such that, when the chute 20 is engaged with the carriage 15 in the printing position 2, the controller interconnects 45 are aligned with the printhead interconnects 40 of the cartridges 22 installed in the chute 20. In this embodiment, the printhead interconnects 40 are electrically disconnected from the controller interconnects 45 when the chute 20 is disengaged from the carriage 15 and moved to the service position 4. As shown in the service position 4 of FIG. 7B, the chute 20 has an opening 80 located adjacent to the position of the controller interconnects 45. When the chute 20 is moved to the printing position 2 as shown in FIG. 7A, the printhead interconnects 40 of an installed cartridge 22 mate with the controller interconnects 45 through the opening 80. Force sufficient to maintain good electrical contact is applied by a latching mechanism 53, as described more fully in the above-referenced co-pending application Ser. No. 09/303,256.

A number of alternative cartridge configurations and ink delivery systems usable with the present invention are known to those skilled in the art. In a preferred embodiment, the chute holds two cartridges, one for black, and the other a tri-color cartridge having three separate ink reservoirs for cyan, magenta, and yellow. An alternate embodiment has four receiving spaces to hold four cartridges, each printing a different color such as black, cyan, magenta, and yellow.

Figure 8A:
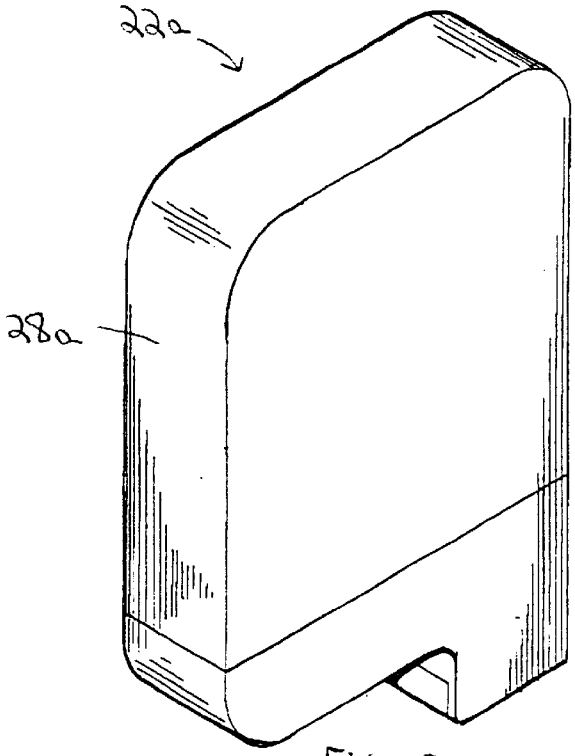
FIG. 8A PRIOR ART
FIGS. 8A–8D are schematic representations of prior art printhead and print reservoir configurations usable in a printer according to the present invention.
Figure 8B:
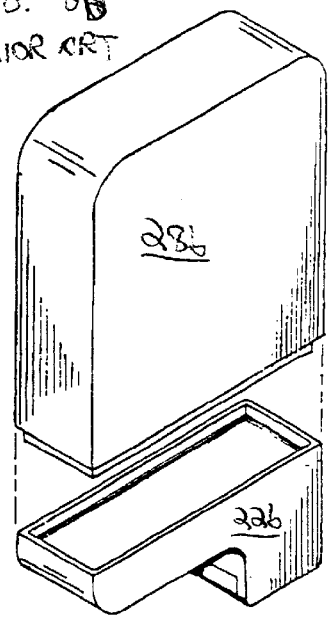
FIG. 8B PRIOR ART
Figure 8C:
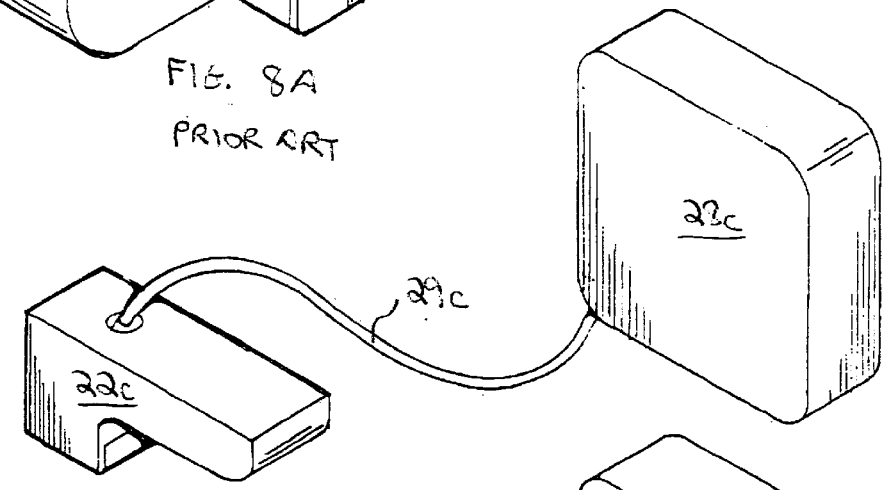
FIG. 8C PRIOR ART
Figure 8D:
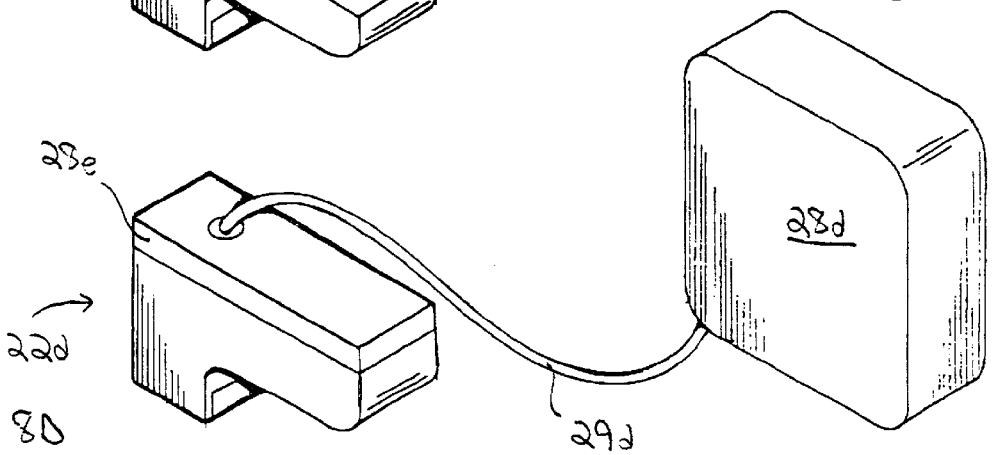
FIG. 8D PRIOR ART

Yet another embodiment holds only a single black cartridge. As shown schematically in FIGS. 8A through 8D, the ink may be supplied to the printhead in different ways. In FIG. 8A, an ink reservoir 28*a* is located within the print cartridge 22*a*. In FIG. 8B, an ink reservoir 28*b* is detachable from the print cartridge 22*b*, but the reservoir 28*b* is attached to the print cartridge 22*b* when they are installed in the chute 20. In FIG. 8C, the print cartridge 22*c* does not contain an ink reservoir; ink is supplied to the cartridge 22*c* instead from an off-chute ink reservoir 28*c* via a tube 29*c*. In FIG. 8D, the main ink reservoir 28*d* is similarly located off-chute and connected to the print cartridge 22*d* via a tube 29*d*, but the print cartridge 22*d* also contains an auxiliary reservoir 28*e*. The present invention may be utilized with any of the abovementioned cartridge configurations and ink delivery systems, and with other design alternatives in which the printhead 25 and the print media 6 are in relative motion to each other.

From the foregoing it will be appreciated that the displaceable print cartridge chute provided by the present invention represents a significant advance in the art. An inkjet printer can be constructed according to the present invention so as to provide access to the print cartridges through a side of the printer rather than through the top. Such a printer can advantageously be stacked with or below other electronics equipment to minimize footprint or floor space.

Although several specific embodiments of the invention have been described and illustrated, the invention is not to be limited to the specific methods, forms, or arrangements of parts so described and illustrated. The invention is limited only by the claims.

What is claimed is:

1. A stackable inkjet printer for ejecting ink from at least one print cartridge onto a sheet of print medium, comprising:

an enclosure having top and bottom planar surfaces to facilitate stacking the enclosure below another enclosure having similar top and bottom surfaces;

the enclosure further having a plurality of vertical wall members, one of the plurality of vertical wall members having an access opening to provide a passageway into an interior portion of the enclosure; and a moveable chute mounted for rectilinear travel along a carriage axis within the interior of the enclosure, the chute for holding the at least one print cartridge in a printing position and being moveable about at least one end of the carriage axis to a service position displaced from the printing position to facilitate installation and removal of the print cartridge through the access opening.

2. The stackable inkjet printer of claim 1, wherein the access opening in the one vertical wall member is located where the chute intersects the one vertical wall member as the chute moves from the printing position to the service position.

3. The stackable inkjet printer of claim 1, wherein the service position is at least partially outside the enclosure.

4. The stackable inkjet printer of claim 3, wherein the height and the width of the access opening are sufficient to position the chute at least partially outside the enclosure.

5. The stackable inkjet printer of claim 1, wherein the printer enclosure further includes a side generally orthogonal to and adjacent an end of the carriage axis, and wherein the service position is angularly displaced from the printing position about an axis generally orthogonal to the carriage axis.

6. The stackable inkjet printer of claim 5, wherein the mechanism is a pivot attached to an end of the carriage adjacent the end of the carriage axis.

7. The stackable inkjet printer of claim 6, wherein the pivot is a hinge.

8. The stackable inkjet printer of claim 6, wherein the pivot is a sliding guide.

9. The stackable inkjet printer of claim 6, wherein the pivot is a multiple bar linkage.

10. The stackable inkjet printer of claim 1, further comprising a handle attached to the chute and accessible from outside the printer enclosure through the access opening for displacing the chute.

11. The stackable inkjet printer of claim 1, further comprising a first latch device attached to the chute for engaging the carriage so as to hold the chute in the printing position.

12. The stackable inkjet printer of claim 11, wherein the first latch device is disengagable from the carriage so as to allow the chute to move to the service position to install or remove the print cartridge from the carriage.

13. The stackable inkjet printer of claim 1, wherein the access opening is located in a side member of the printer enclosure.

14. The stackable inkjet printer of claim 13, further comprising a second latch device attached to the printer enclosure proximate the access opening for engaging the chute to hold the chute in the service position.

15. The stackable inkjet printer of claim 14, wherein the second latch device is disengagable from the chute so as to allow the chute to move to the printing position.

16. The stackable inkjet printer of claim 1, further comprising a cover over the access opening removably engaged with the side member.

17. The stackable inkjet printer of claim 1, further comprising a cover over the access opening pivotally engaged with the side member.

18. The stackable inkjet printer of claim 1, wherein the print cartridge has a first plurality of electrical interconnects for controlling the emission of the ink from the print cartridge to the media, the printing system further comprising:

a second plurality of electrical interconnects connected to a print controller and detachably engaging the first plurality of electrical interconnects to control the emission of the ink.

19. The stackable inkjet printer of claim 18, wherein the second plurality of electrical interconnects is disposed within the chute and engages the first plurality of electrical interconnects when the print cartridge is inserted into the chute.

20. The stackable inkjet printer of claim 19, wherein the second plurality of electrical interconnects remains engaged with the first plurality of electrical interconnects when the print cartridge is located in both the printing position and the service position.

21. The stackable inkjet printer of claim 18, wherein the second plurality of electrical interconnects is disposed on the surface of the carriage, the second plurality of electrical interconnects engaging the first plurality of electrical interconnects through an opening in the chute when the print cartridge is in the printing position and disengaging the first plurality of electrical interconnects when the print cartridge is in the service position.

22. The stackable inkjet printer of claim 1, further comprising alignment means for aligning the chute with the carriage.

23. The stackable inkjet printer of claim 22, wherein the alignment means includes a first mating member on the carriage and a second mating member on the chute positioned to engage the first mating member when the chute is engaged with the carriage.

24. The stackable inkjet printer of claim 1, wherein the service position is substantially perpendicular to the carriage axis.

25. The stackable inkjet printer of claim 1, wherein the service position is coextending with the carriage axis.

26. A method of accessing a print cartridge removably mounted in a chute, the chute detachably engaged to a carriage for transporting the print cartridge along a carriage axis within an enclosure of an inkjet printer, comprising:

disengaging the chute from the carriage;

moving the chute from a printing position adjacent a print media to a service position displaced from the printing position; and accessing the print cartridge in the service position.

27. The method of claim 26, wherein accessing the print cartridge includes removal, further comprising:

installing a new print cartridge in the chute while the chute is located in the service position;

moving the chute from the service position to the printing position; and engaging the chute with the carriage.

28. The method of claim 26, further comprising:

moving the carriage along the carriage axis to a side of the enclosure generally orthogonal to the carriage axis and adjacent the service position.

29. The method of claim 26, wherein the chute is located within the enclosure in the printing position and the chute is located at least partially outside the enclosure in the service position.

30. The method of claim 26, further comprising:

latching the chute to a side of the enclosure while the chute is in the service position in order to maintain the chute in the service position during the accessing step.

31. The method of claim 30, further comprising:

unlatching the chute from the side of the enclosure.

32. A printing system for applying an ink to a print media, comprising:

a printer enclosure;

a chute for removably receiving a print cartridge containing a printhead for applying the ink;

a carriage attached to the chute for transporting the print cartridge within the enclosure along a carriage axis;

a mechanism connected between the chute and the carriage for alternatively positioning the print cartridge in a printing position adjacent to the print media within the enclosure and in a service position displaced from the printing position; and an access opening in the enclosure proximate to the service position, the access opening having a height and a width sufficient to access the print cartridge when the chute is in the service position.

33. A stackable inkjet printer having a print mechanism including a chute movably mounted thereto for receiving at least one print cartridge for ejecting ink onto a sheet of print medium, comprising:

an enclosure having top and bottom planar surfaces to facilitate stacking the enclosure below another enclosure having similar top and bottom surfaces;

a plurality of vertical wall members joined to the top and bottom planar surfaces to form a corresponding plurality of sides of the enclosure, the top and bottom surfaces and plurality of sides defining an interior portion of the enclosure containing the print mechanism;

an access opening in one of the plurality of vertical wall members defining a passageway into the interior portion; and a displacement mechanism attached between the chute and the print mechanism for displacing the chute from a printing position in which the at least one print cartridge is inaccessible from outside the enclosure into a service position in which the at least one print cartridge is accessible from outside the enclosure through the access opening for allowing installation and removal of the print cartridge.

* * * * *

UNITED STATES PATENT AND TRADEMARK OFFICE

CERTIFICATE OF CORRECTION

PATENT NO. : 6,328,415 B1
DATED : December 11, 2001
INVENTOR(S) : Norton et al.

It is certified that error appears in the above-identified patent and that said Letters Patent is hereby corrected as shown below:

Column 10,
Line 24, delete “claim 14” and insert in lieu thereof -- claim 16 --.

Signed and Sealed this

Twenty-fifth Day of June, 2002

*Attest:*

*Attesting Officer*

JAMES E. ROGAN
*Director of the United States Patent and Trademark Office*